US005946944A

United States Patent [19]

Osborne

[11] Patent Number: 5,946,944

[45] Date of Patent: Sep. 7, 1999

[54] SEAMLESS CIRCULAR KNIT BRASSIERE AND METHOD OF MAKING SAME

[75] Inventor: Harold Gene Osborne, Boomer, N.C.

[73] Assignee: Alba-Waldensian, Inc., Valdese, N.C.

[21] Appl. No.: 08/846,874

[22] Filed: May 1, 1997

[51] Int. Cl.[6] ..... A41B 9/16

[52] U.S. Cl. ..... 66/176; 450/92

[58] Field of Search ..... 66/171, 176, 169 R, 66/170, 189; 450/86, 92

[56] References Cited

U.S. PATENT DOCUMENTS

| | | | |
|---|---|---|---|
| 2,218,413 | 10/1940 | Bell | 66/171 X |
| 2,406,969 | 9/1946 | Silman | 66/176 |
| 2,618,139 | 11/1952 | Silman | 66/176 |
| 2,966,785 | 1/1961 | Goff et al. | 66/176 |
| 3,216,425 | 11/1965 | De Keersmaecker | 450/86 X |
| 3,421,513 | 1/1969 | Landau . | |
| 3,425,246 | 2/1969 | Knohl | 66/176 X |
| 3,537,279 | 11/1970 | Epley . | |
| 3,985,003 | 10/1976 | Reed | 66/171 X |
| 4,341,219 | 7/1982 | Kuznetz . | |
| 4,531,525 | 7/1985 | Richards . | |
| 4,624,115 | 11/1986 | Safrit et al. . | |
| 4,682,479 | 7/1987 | Pernick . | |
| 5,031,424 | 7/1991 | Peleg et al. . | |
| 5,081,854 | 1/1992 | Lonati . | |
| 5,479,791 | 1/1996 | Osborne . | |
| 5,553,468 | 9/1996 | Osborne . | |

FOREIGN PATENT DOCUMENTS

| | | | |
|---|---|---|---|
| 1003382 | 9/1965 | United Kingdom | 66/171 |

*Primary Examiner*—John J. Calvert
*Assistant Examiner*—Larry D. Worrell, Jr
*Attorney, Agent, or Firm*—Alston & Bird LLP

[57] ABSTRACT

A seamless brassiere, and methods and blank for making the brassiere are described. In particular, a tubular blank is circularly knit, and first and second walewise extending longitudinal openings are formed along opposite sides of the blank, to form torso and neck openings for the brassiere. The blank ends are trimmed, if desired, to form the desired contour for the arm openings, then banding is applied to each of the torso, neck and arm openings, to thereby form a finished brassiere. At least the banding secured to the torso opening is elastic, in order that the garment may be secured closely about a wearer. In the finished seamless brassiere, the courses extend vertically, while the knit wales extend horizontally when the brassiere is worn, which provides an enhanced level of support for the wearer's breasts.

18 Claims, 1 Drawing Sheet

SEAMLESS CIRCULAR KNIT BRASSIERE AND METHOD OF MAKING SAME

BACKGROUND OF THE INVENTION

1. Field of the Invention

The present invention relates to a brassiere, a blank for making the brassiere, and to methods of making the brassiere and blank. More specifically, the invention relates to a method for making a seamless brassiere on a circular knitting machine, a blank for making the seamless brassiere, and the seamless brassiere itself.

2. Description of the Prior Art

Brassieres are generally manufactured using full fashioned knitting processes and/or a plurality of cut and sewn pieces, in order to provide a structure which adequately supports of a wearer's breasts. While such processes produce satisfactory products in many respects, they tend to be labor intensive, slow to produce, and thus relatively expensive. Further, because brassieres are worn immediately next to a wearer's body and are generally very close-fitting, many wearers experience discomfort where the seams contact their flesh. Not only can such seams chafe when relative movement occurs between the wearer and the brassiere, but the protuberances which generally accompany seams can press against the wearer's skin uncomfortably, often leaving indentations and/or marks on the wearer's skin when the garment is removed. In addition, because the production of garment seams usually requires the input of labor, one can expect the costs of manufacturing a garment to increase as the number of seams increases.

In order to reduce the costs associated with the manufacture of such cut and sewn articles, attempts have been made to produce brassieres using circular knitting processes. For example, U.S. Pat. No. 4,531,525 to Richards describes a tubular brassiere blank which is knit on a circular knitting machine, then slit lengthwise, folded over and sewn together at lateral seam lines to form a finished brassiere. The lateral seam lines are thus positioned along opposite sides of the wearer, at positions substantially below the wearer's armpits. Because this tends to be a particularly sensitive area of the body and the tightest-fitting portion of brassieres tends to be the torso encircling portion, such seam lines can cause great discomfort, particularly when the brassiere is sufficiently close-fitting to provide good breast support.

Another method for producing brassieres having a minimal number of seams is described in commonly-assigned U.S. Pat. Nos. 5,479,791 and 5,553,468 to Osborne. Those patents describe the circular knitting of a tubular brassiere blank having a lower torso-encircling welt, integrally knit breast cups and integrally knit shoulder straps. The blank is cut and seamed only at the shoulders, and banding is sewn around the neck opening and arm openings to form a finished brassiere. The resulting brassiere thus has only a minimal number of seams (i.e., only those joining the front shoulder straps to the rear shoulder straps), and the seams are located at a more comfortable position on the wearer's body than those of the Richards patent.

Thus, although the brassiere having seams only on the shoulder straps represents a major improvement over prior art structures, for the sake of wearer comfort and to reduce the labor input required for product manufacture, it would still be desirable to eliminate seams altogether.

SUMMARY OF THE INVENTION

With the foregoing in mind, it is therefore an object of the present invention to provide a seamless brassiere which provides good comfort and breast support for a wearer.

It is also an object of the instant invention to provide a blank which can be converted into a seamless brassiere using only a minimal number of production steps.

It is a further object of the invention to provide a method for making a seamless brassiere using only a minimal number of production steps.

These and other objects are achieved by providing a brassiere which is produced from a single circularly knit tubular blank so as to have no seams, except for those joining finishing-type banding to the brassiere. In one form of the invention, a continuous tubular blank is knit on a circular knitting machine, then first and second walewise extending longitudinal openings are cut to form a neck opening and a torso opening. If desired, the tube is either knit to the desired length so that the respective tube ends form the arm openings, or else the tube is cut to the desired length to form first and second arm openings. Banding material is then secured about each of the neck, torso and arm openings in order to form a finished brassiere. In a preferred form of the invention, at least the banding secured to the torso opening is elastic and it is sewn to the blank while the band is in an extended condition, so that it tends to retract against a wearer's torso in order to secure the brassiere closely thereabout in a known manner.

In another form of the invention, one or both of the first and second longitudinal openings are integrally formed during the knitting of the tubular blank by dropping a predetermined number of knit stitches for a predetermined number of courses along one or both opposite sides of the tubular blank. It is noted that throughout this application where reference is made to a number of dropped stitches, provision is desirably made so that the previous course is kept from raveling, as will be readily understood by those having skill in the art. Where both openings are integrally formed on the knitting machine, the blank has been knit to the desired length, the banding can simply be secured to the blank without requiring any cutting steps. Alternatively, if desired, the ends of the blank can be trimmed to form the arm openings or to shape the straps to a particular configuration.

The resulting brassiere is seamless, and the knit wales extend substantially horizontally around the garment (and thus the wearer) while the courses extend vertically. In addition to this structure providing a seamless garment, this orientation of the knit fabric has been found to provide added support for the wearer's breasts.

Furthermore, the knit stitches forming the tube can also be modified in select locations to form cups and/or shaping panels for the brassiere, in a manner such as that described in commonly-assigned U.S. Pat. No. 5,592,836, which is incorporated herein by reference.

Other objects, features and advantages of the present invention will become apparent from the following detailed description when taken in conjunction with the accompanying drawings.

DETAILED DESCRIPTION OF THE INVENTION

Figure 1:
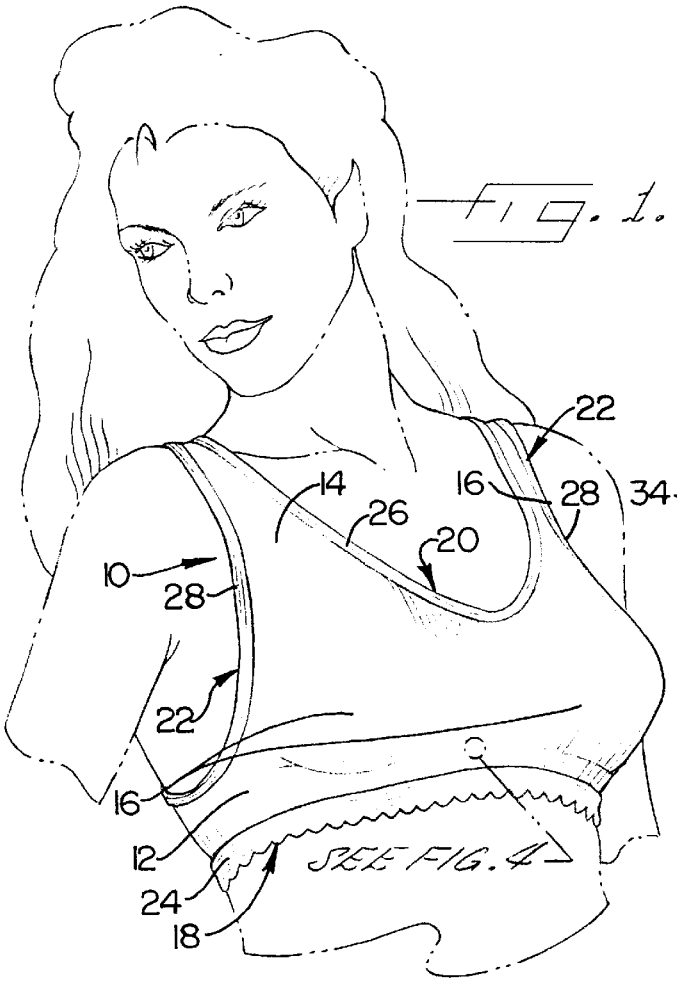
FIG. 1 is a perspective view illustrating an embodiment of a brassiere of the present invention as it appears when worn by a wearer.

With reference to the drawings, FIG. 1 is a perspective environmental view of a woman wearing a brassiere 10 made according to the instant invention. As described above, the brassiere 10 is seamless and includes a seamless torso portion 12 for encircling at least the upper torso of a wearer and a breast region thereof. The brassiere 10 also includes first and second seamless straps 14 which are integrally knit with the torso portion, in order that a seamless garment is obtained.

In a preferred form of the invention, the brassiere 10 also includes first and second shaped breast cups 16 for accommodating a wearer's breasts. Such cups can be formed in a manner such as that described in commonly-assigned U.S. Pat. Nos. 5,479,791 and 5,553,468 to Osborne, which are incorporated herein by reference, or in any conventional manner for forming shaped regions in a circularly knit garment such as by periodically modifying the stitch configuration or length, varying the yarn input, etc. Alternatively, the stitch pattern in a region between the breasts can be modified to provide fullness on either side thereof to define shaped cups 16. In one embodiment of the invention, one or more regions having a greater resistance to stretch than surrounding areas can be knit into the brassiere to define one or more support panels (not shown), such as those described in commonly-assigned U.S. Pat. No. 5,592,836.

The brassiere 10 also desirably includes a torso opening 18, a neck opening 20, and first and second arm openings 22, for receiving the respective portions of a wearer's body in order that the garment may be worn. In a preferred form of the invention, banding 24 is secured about the torso opening 18, in order to assist in the securement of the brassiere about a wearer's body. In a particularly preferred form of the invention, the banding 24 secured to the torso opening is elastic and is sewn to the blank while the band is in an extended condition, so that it tends to retract against a wearer's torso in order to secure the brassiere closely thereabout. Similarly, banding 26 is desirably secured to the neck opening 20 to, among other things, provide a finished appearance to the garment and prevent the brassiere material from fraying. Although it is also preferred to use an elastic banding material for the banding 26 secured to the neck opening 20, it is noted that other finishing-type materials can be used, such as lace trim or the like.

Banding 28 is also desirably secured to the arm openings 22, in order to provide a finished appearance to the garment and prevent the brassiere material from fraying. It is also noted that where desired, the banding 24, 26, and 28 can be used to assist in the overall shaping of the brassiere 10. For example, the brassiere fabric can be gathered slightly as it is sewn to the banding to assist in forming a three-dimensionally shaped brassiere.

Figure 4:
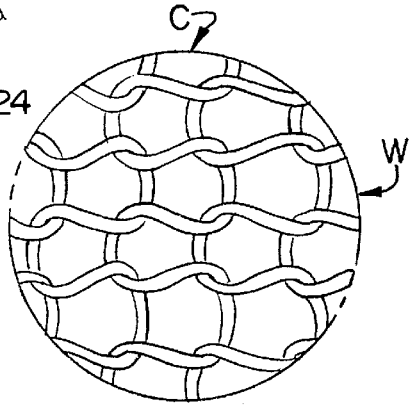
FIG. 4 is a greatly enlarged view of a section of the fabric forming the brassiere illustrated in FIG. 1.

As shown in FIG. 4, the fabric forming the brassiere extends perpendicularly to the fabric orientation of prior art brassieres; i.e., the courses C extend vertically along the torso portion 12, straps 14, and breast cups 16, where applicable, while the knit wales W extend horizontally. Surprisingly, it has been found that this orientation not only enables the production of a seamless brassiere, but it also provides a high degree of support for the wearer's breasts.

Figure 2:
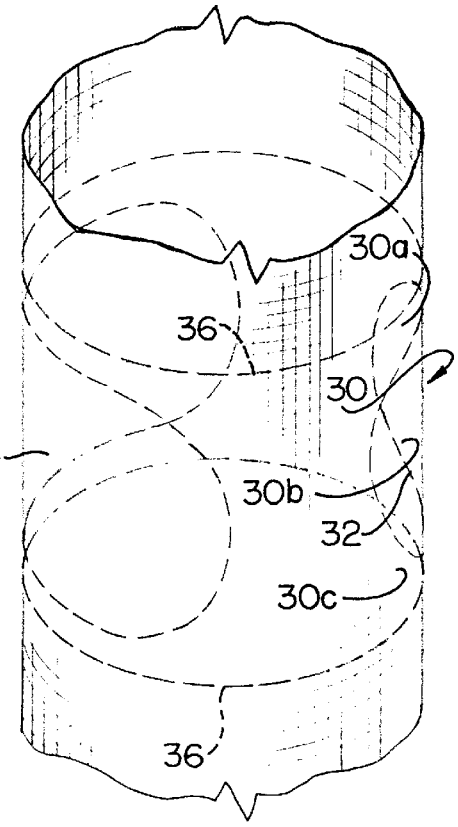
FIG. 2 is a front elevational view of a blank according to the instant invention which can be readily converted into the brassiere illustrated in FIG. 1.
Figure 3:
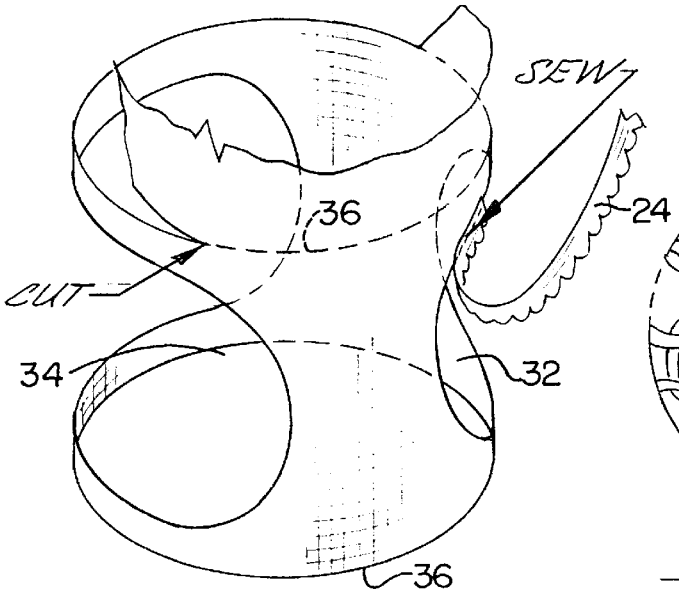
FIG. 3 is a front elevational view of the blank of FIG. 2, as it appears when being converted into a brassiere.

A method of producing a brassiere 10 is described with reference to FIGS. 2 and 3, which illustrate a blank for making a brassiere according to the instant invention. A tubular blank 30 is knit on a circular knitting machine. In one method of the invention, the blank 30 includes a first series of substantially continuous knit courses defining a first tubular blank section 30*a* for forming a first strap 22 of the brassiere. A second series of courses defining a second tubular blank section 30*b* is knit to the first series of courses 30*a*. In this method of the invention, a predetermined number of knit stitches are dropped along a central portion of one side of the second blank section 30*b*, to define an integrally formed walewise extending longitudinal opening therein. This integrally formed opening 32, 34 defines either the torso opening 18 of the finished brassiere (as illustrated) or the neck opening 20 of the brassiere. A third substantially continuous series of courses is knit to the second blank section 30*b* top define a third blank section 30*c* for forming a second brassiere strap. In this method of the invention, the blank 30 is flattened, and the second opening is cut along a central portion of the opposite side of the blank, to form the other of the torso and neck openings 32, 34. Alternatively, a predetermined number of knit stitches can be dropped along each of the opposite sides of the blank 30 to integrally form each of the respective torso and neck openings 32, 34.

The blank 30 can be knit to a desired length such that the arm openings 36 are automatically formed to shape; alternatively, a portion of one or both of the ends of the tubular blank 30 can be cut or shaped as desired to form the arm openings 36. Banding (see e.g., 24 in FIG. 3) is then desirably secured about each of the respective torso, neck and arm openings 32, 34, 36. As described, it is preferred that at least the banding 24 being secured about the torso opening 32 is elastic, and is secured while the banding is in its extended form in order that the banding can retract to secure the garment about a wearer's body in a close-fitting manner. Also, the material of the blank 30 can be gathered as the banding is secured about the openings, in order to provide a three-dimensionally shaped garment more closely conforming to that of the human body. Although sewing is a preferred means of securing the banding 24, 26, 28 to the garment, other means such as adhesive bonding may be utilized within in the scope of the invention.

In another method of the invention, a substantially continuous tubular blank is produced and then flattened, and the material is cut to form the torso and neck openings 32, 34. Because this embodiment results in greater material waste, it can be desirable to knit the portions of the blank which are to be removed from a less expensive or smaller yarn, in a manner which is known to those of ordinary skill in the art.

As described, the resulting brassiere is seamless, and the knit courses of the fabric extend vertically while the knit wales extend horizontally about the finished brassiere. This brassiere not only reduces the discomfort typically associated with seams in prior art brassieres, but enables the rapid manufacture of a brassiere having good support for the wearer's breasts.

In the drawings and specification there has been set forth a preferred embodiment of the invention, and although specific terms are employed, they are used in a generic and descriptive sense only and not for purposes of limitation, the scope of the invention being defined in the claims.

That which is claimed:

1. A method of making a blank for forming a substantially seamless brassiere comprising the steps of:

knitting a first substantially continuous series of courses defining a first tubular blank section for forming a first strap of a brassiere;

knitting to said first tubular blank section a second series of courses defining a second tubular blank section for forming a torso encircling portion of a brassiere, and while knitting said second series of courses, dropping knit stitches to define a first walewise extending longitudinal opening along said second tubular blank section for forming a wearer receiving opening of a brassiere, then knitting to said second series of courses a third series of substantially continuous courses defining a third tubular blank section for forming a second strap of a brassiere.

2. A method of making a blank for forming a substantially seamless brassiere comprising the steps of:

knitting a first substantially continuous series of courses defining a first tubular blank section for forming a first strap of a brassiere;

knitting to said first tubular blank section a second series of courses defining a second tubular blank section for forming a torso encircling portion of a brassiere, and while knitting said second series of courses, dropping knit stitches to define a first walewise extending longitudinal opening along said second tubular blank section for forming a wearer receiving opening of a brassiere and modifying said series of courses to form first and second shaped breast cups one above the other lengthwise along the blank along a region adjacent to said first longitudinal opening, then knitting to said second series of courses a third series of substantially continuous courses defining a third tubular blank section for forming a second strap of a brassiere.

3. The method according to claim 1, wherein said step of knitting a second series of courses further comprises modifying said series of courses to define at least one region having a greater resistance to stretch than surrounding areas of the blank, to thereby define a support panel for a brassiere.

4. A circularly knit blank for the manufacture of a substantially seamless brassiere comprising:

a first substantially continuous series of courses defining a first tubular blank section for forming a first brassiere strap;

a second series of courses defining a second tubular blank section for forming a torso encircling portion of a brassiere, said second series of courses being knit to said first tubular blank section and including a series of dropped stitches defining a first walewise extending longitudinal opening along said second tubular blank section, said opening for defining a wearer receiving opening of a brassiere, wherein said second series of courses further includes a second series of dropped knit stitches defining a second longitudinal opening along an opposite side of said second tubular blank section, thereby defining front and rear blank sections between the respective openings for forming a torso encircling portion of a brassiere, and third substantially continuous series of courses knit to said second series of courses and defining a third tubular blank section for forming a second brassiere strap.

5. A circularly knit blank for the manufacture of a substantially seamless brassiere comprising:

a first substantially continuous series of courses defining a first tubular blank section for forming a first brassiere strap;

a second series of courses defining a second tubular blank section for forming a torso encircling portion of a brassiere, said second series of courses being knit to said first tubular blank section and including a series of dropped stitches defining a first walewise extending longitudinal opening along said second tubular blank section, said opening for defining a wearer receiving opening of a brassiere, wherein said second tubular blank section includes first and second shaped breast cups positioned one above the other lengthwise along the blank along a region adjacent to said first longitudinal opening and a third substantially continuous series of courses knit to said second series of courses and defining a third tubular blank section for forming a second brassiere strap.

6. The blank according to claim 4, wherein said second tubular blank section includes at least one integrally knit region having a greater resistance to stretch than surrounding regions, for forming a support panel for a brassiere.

7. A method of making a substantially seamless brassiere comprising the steps of:

knitting a series of courses defining a tubular blank having first and second ends;

forming a first longitudinal opening along a central region of a first side of said blank and forming a second longitudinal opening along a central region of the side of the tubular blank opposite said first side;

attaching banding to each of said first and second ends and to said first and second longitudinal openings, to thereby define a substantially seamless brassiere.

8. The method according to claim 7, wherein said step of forming a first longitudinal opening along a central region of a first side of the blank comprises dropping a predetermined number of knit stitches while forming said blank, to thereby integrally form said opening.

9. The method according to claim 8, wherein said step of forming a second longitudinal opening along a central region of a second side of the blank comprises dropping a predetermined number of knit stitches while forming the blank, to thereby integrally form said opening.

10. The method according to claim 7, wherein said step of forming said first and second longitudinal openings comprises cutting said blank and removing a portion of the material thereof to form said first and second longitudinal openings.

11. The method according to claim 7, wherein said step of knitting a series of courses defining a tubular blank comprises knitting first and second breast cups positioned one above the other lengthwise along the blank along a region adjacent to said first longitudinal opening.

12. The method according to claim 7, wherein said step of knitting a series of courses further comprises modifying said series of courses to define at least one region having a greater resistance to stretch than surrounding areas of the blank, to thereby define a support panel for the brassiere.

13. A circularly knit brassiere comprising a plurality of knit courses forming a seamless upper torso encircling portion and integrally knit seamless shoulder straps, wherein said knit courses extend vertically along said upper torso encircling portion and shoulder straps.

14. The brassiere according to claim 13, wherein said upper torso encircling portion includes first and second shaped breast cups.

15. The brassiere according to claim 13, further comprising at least one support panel having a greater resistance to stretch than surrounding areas of said brassiere.

16. The brassiere according to claim 15, wherein said upper torso encircling portion includes a torso opening and a neck opening, and said straps define first and second arm openings, and further comprising banding secured to each of said torso, neck and arm openings.

17. The method according to claim 2, wherein said step of knitting a second series of courses further comprises modifying said series of courses to define at least one region having a greater resistance to stretch than surrounding areas of the blank, to thereby define a support panel for a brassiere.

18. The blank according to claim 5, wherein said second tubular blank section includes at least one integrally knit region having a greater resistance to stretch than surrounding regions, for forming a support panel for a brassiere.

* * * * *

UNITED STATES PATENT AND TRADEMARK OFFICE

CERTIFICATE OF CORRECTION

PATENT NO. : 5,946,944

DATED : September 7, 1999

INVENTOR(S) : Osborne

It is certified that error appears in the above-identified patent and that said Letters Patent is hereby corrected as shown below:

Column 5, line 58, before "third" insert --a--.

Column 6, line 10, after "opening" insert a comma (,).

Column 7, line 1, "claim 15" should read --claim 13--.

Signed and Sealed this

Twenty-second Day of February, 2000

*Attest:*

Q. TODD DICKINSON

*Attesting Officer*

*Commissioner of Patents and Trademarks*